US005154350A

United States Patent [19]

Ausiello et al.

[11] Patent Number: 5,154,350

[45] Date of Patent: Oct. 13, 1992

[54] ELECTROMAGNETICALLY ACTUATED FUEL INJECTION DEVICE FOR AN INTERNAL COMBUSTION ENGINE

[75] Inventors: Francesco P. Ausiello, Bologna; Mario Ricco, Bari, both of Italy

[73] Assignee: Weber S.r.L., Torino, Italy

[21] Appl. No.: 678,807

[22] Filed: Apr. 1, 1991

[30] Foreign Application Priority Data

Apr. 6, 1990 [IT] Italy ..... 67258 A/90

[51] Int. Cl.[5] ..... F02M 47/02; F02M 51/06

[52] U.S. Cl. ..... 239/96; 239/533.8; 239/585.3

[58] Field of Search ..... 239/90, 91, 96, 124, 239/533.8, 585

[56] References Cited

U.S. PATENT DOCUMENTS

| | | | |
|---|---|---|---|
| 3,777,977 | 12/1973 | Regneault et al. | 239/533.8 X |
| 4,200,231 | 4/1980 | Knape | 239/96 X |
| 4,454,990 | 6/1984 | Lewis | 239/585 |
| 4,483,485 | 11/1984 | Kamiya et al. | 239/585 |
| 4,899,935 | 2/1990 | Yoshida et al. | 239/533.8 X |
| 4,905,907 | 3/1990 | Ricco | 239/533.8 |
| 4,946,103 | 8/1990 | Ganser | 239/585 X |
| 4,946,106 | 8/1990 | Turchi et al. | 239/533.8 X |
| 4,982,902 | 1/1991 | Knapp et al. | 239/585 |
| 4,993,636 | 2/1991 | Taue et al. | 239/533.8 X |

FOREIGN PATENT DOCUMENTS

| | | | |
|---|---|---|---|
| 0304747 | 3/1989 | European Pat. Off. . | |
| 0331200 | 9/1989 | European Pat. Off. . | |
| 0333097 | 9/1989 | European Pat. Off. . | |
| 0334364 | 9/1989 | European Pat. Off. . | |
| 2039993 | 8/1980 | United Kingdom | 239/585 |

*Primary Examiner*—Andres Kashnikow
*Assistant Examiner*—William Grant
*Attorney, Agent, or Firm*—Baker & Daniels

[57] ABSTRACT

The subject of the invention is an improvement in the pilot valve which is adapted to control the passage of fuel through a discharge aperture which communicates with a control chamber with which the device is provided; fuel is supplied under pressure into this control chamber and is discharged through the first mentioned discharge aperture to control the opening of a shutter needle with which the device is provided for the purpose of injecting a suitable quantity of fuel through at least one injection orifice. According to this improvement the armature of the pilot valve substantially comprises a rod which traverses an axial hole in the core of an electromagnet. The first end of the rod is fixed to the armature. A stop member, the position of which is adjustable with respect to the body of the device, is adapted to constitute an abutment for the second end of the rod. A ball is interposed between this second end and the stop member. A threaded ring nut presses against the elongate body housing the needle so as to fix the valve body and resist the force on the valve body exerted by the fuel under pressure.

7 Claims, 2 Drawing Sheets

ELECTROMAGNETICALLY ACTUATED FUEL INJECTION DEVICE FOR AN INTERNAL COMBUSTION ENGINE

BACKGROUND OF THE INVENTION

The present invention relates to an electromagnetically actuated fuel injection device for an internal combustion engine.

A device of this type substantially comprises a body of elongate form, an injection nozzle fixed to the body and provided with at least one fuel injection orifice and a shutter needle movable axially within the interior of the body and of the nozzle between a closure position in which it closes the said orifice and an open position in which it leaves the passage through the orifice itself unobstructed.

This device further includes a valve body housed within the interior of the said body of elongate form and in which there is formed a control chamber into which fuel under high pressure is supplied through a fuel inlet aperture and from which this fuel is discharged through a discharge aperture; the said valve body is disposed above the said shutter needle which delimits the lower part of the first-defined control chamber.

An electromagnetically actuated pilot valve also forms part of a device of this type, this valve being operable to control the passage of fuel through the discharge aperture; such a valve substantially comprises a shutter member operable to close the discharge aperture, the shutter member being fixed to an armature in the form of a disc, urged towards the discharge aperture by the action of at least one spring and adapted to be attracted by a core of an electromagnet fixed to the body of elongate form to cause the shutter member to move away from the discharge aperture.

The present invention relates to an improvement of the above-mentioned pilot valve which forms part of an electromagnetically actuated fuel injection device.

Pilot valves of the type briefly described have several disadvantages.

First of all some surfaces of the first mentioned valve body in which the control chamber and the fuel inlet and discharge apertures are formed can not be worked with a high surface finish and with close tolerances; this is true in particular of the surface onto which the said discharge outlet opens and against which the shutter member of the pilot valve rests; consequently the function of this valve can be defective, or else to obtain a working finish and acceptable tolerances complex and expensive working operations are required.

Moreover the members which are utilised to fix the valve body to the body of elongate form for the purpose of resisting the high force which must be exerted on the second body and which is generated by the high fuel pressures, is not very reliable. To this end an annular threaded ring nut is usually used, which is fixed to the head of the injector and which has an internally threaded section which is screwed on to a corresponding externally threaded section of the body of elongate form: damage in fact occurs in the connection region of this ring nut with the head since the material of the side wall of the head itself has a low mechanical strength because of its magnetic permeability.

Moreover, when the armature is attracted by the core, a surface of the armature itself comes into contact with a corresponding surface of the core; consequently, because of the residual magnetisation of the armature and the core, the first tends to remain in contact with the second even when the excitation current of the electromagnet ceases: the separation between these two members, which takes place by the action of the first mentioned spring, occurs with a certain delay thereby detrimentally affecting the speed of response of the device.

Again, because of the direct contact between the surface of the armature and that of the core, a certain wear of these surfaces takes place, in particular that of the core, with the disadvantage of varying from the initial calibration conditions of the device; moreover, since this wear is not normally uniform, when the armature comes into contact with the core, it assumes an incorrect position, thereby forming a small angle between the axis of the armature and the axis of the core, with the consequence of detrimentally affecting the seal formed by the pilot valve in its closure position.

Finally, since the stroke of the pilot valve shutter member is determined uniquely in the end of stroke position of the armature with respect to the core it is not possible to effect an adjustment of the opening movement of this valve and therefore to define, in a rigorous way, the working conditions of the device on which the valve is mounted.

SUMMARY OF THE INVENTION

The object of the present invention is that of providing an electromagnetically actuated fuel injection device for a diesel cycle engine, of the type briefly described above, which eliminates the above-described disadvantages.

This object is obtained by means of an electromagnetically actuated fuel injection device for an internal combustion engine comprising:

a body of elongate form;

an injection nozzle fixed to the body and provided with at least one fuel injection orifice;

a shutter needle movable axially within the body and the nozzle from a closure position in which it closes the said injection orifice to an open position in which it leaves the passage through the orifice itself unobstructed;

a valve body housed within the interior of the said body of elongate form, in which there is formed a control chamber into which fuel under high pressure is supplied through a fuel inlet opening and from which this fuel is discharged through a discharge aperture, the said valve body being disposed above the said shutter needle which delimits the lower part of the said control chamber an electromagnetically actuated pilot valve acting to control the passage of the fuel through the said discharge aperture, the said valve comprising a shutter member acting to close the said discharge aperture and fixed to a disc-type armature urged towards the said discharge aperture by the action of at least one spring and adapted to be attracted by an electromagnetic core fixed to the said body of elongate form to cause the said shutter member to be displaced from the said discharge aperture;

characterised by the fact that the upper part of the said valve body is delimited by a flat surface onto which opens the said discharge aperture, a threaded ring nut screwed into a threaded axial hole of the said body of elongate form pressing on the said surface in such a way as to fix the said valve body to the said body of elongate form and to resist the force exerted on the said valve body by the said fuel under high pressure.

BRIEF DESCRIPTION OF THE DRAWINGS

For a better understanding of the device of the present invention a more detailed description thereof will now be given by way of example with reference to the attached drawings, in which.

DETAILED DESCRIPTION OF THE INVENTION

Figure 1:
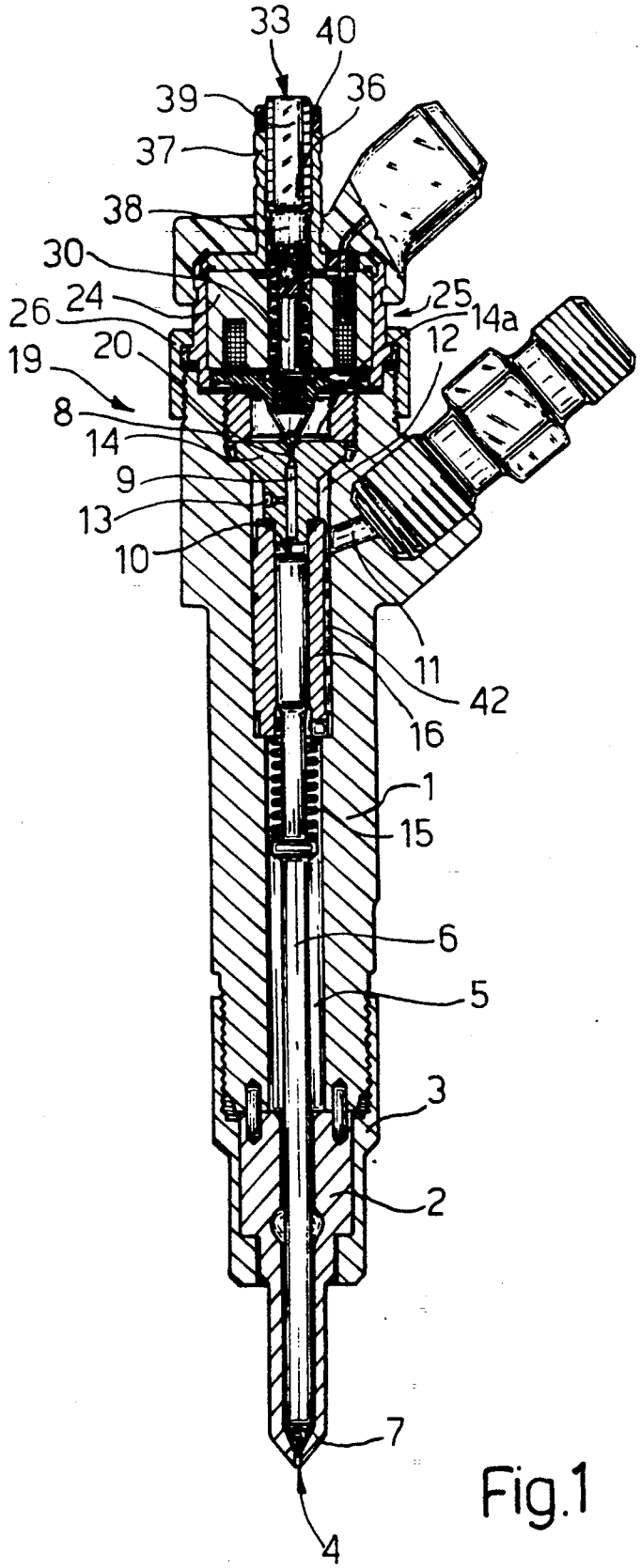
FIG. 1 is an axial section of the injection device of the invention.

First of all, with reference to FIG. 1 the electromagnetically actuated fuel injection device of the invention is adapted to be utilised in a diesel cycle engine, for the purpose of supplying suitable quantities of fuel to a cylinder of the engine itself.

This device substantially comprises a body 1 of elongate form, an injection nozzle 2 fixed to the body in any suitable manner, for example by means of a sleeve 3; the nozzle is provided with at least one injection orifice 4 through which fuel is supplied into the cylinder of the engine; a shutter needle 6 is axially movable within a suitable cavity 5 of the body 1 and of the nozzle 2, which needle can be carried, in a manner which will be described, from a closure position in which the end 7 of the needle itself closes the injection orifice 4, to an open position in which it leaves the passage through this orifice free.

In an axial cavity formed within the interior of the body of elongate form there is housed a valve body 14 in which is formed a control chamber 9. Into this chamber fuel under high pressure is supplied through an inlet aperture 13 which communicates with an annular chamber 12 defined between the valve body and the said axial cavity; the fuel enters the chamber 12 through an inlet aperture 11. As is clearly shown in FIG. 2, the valve body 14 is disposed above the shutter needle 6 which delimits the lower part of the control chamber 9.

As is seen from FIG. 1, the shutter needle 6 is normally urged downwardly to close the injection orifice 4 by the action of a coil spring 15 interposed between an annular projection of the needle itself and another sleeve 16 housed within the interior of the cavity 5 of the body 1.

Figure 2:
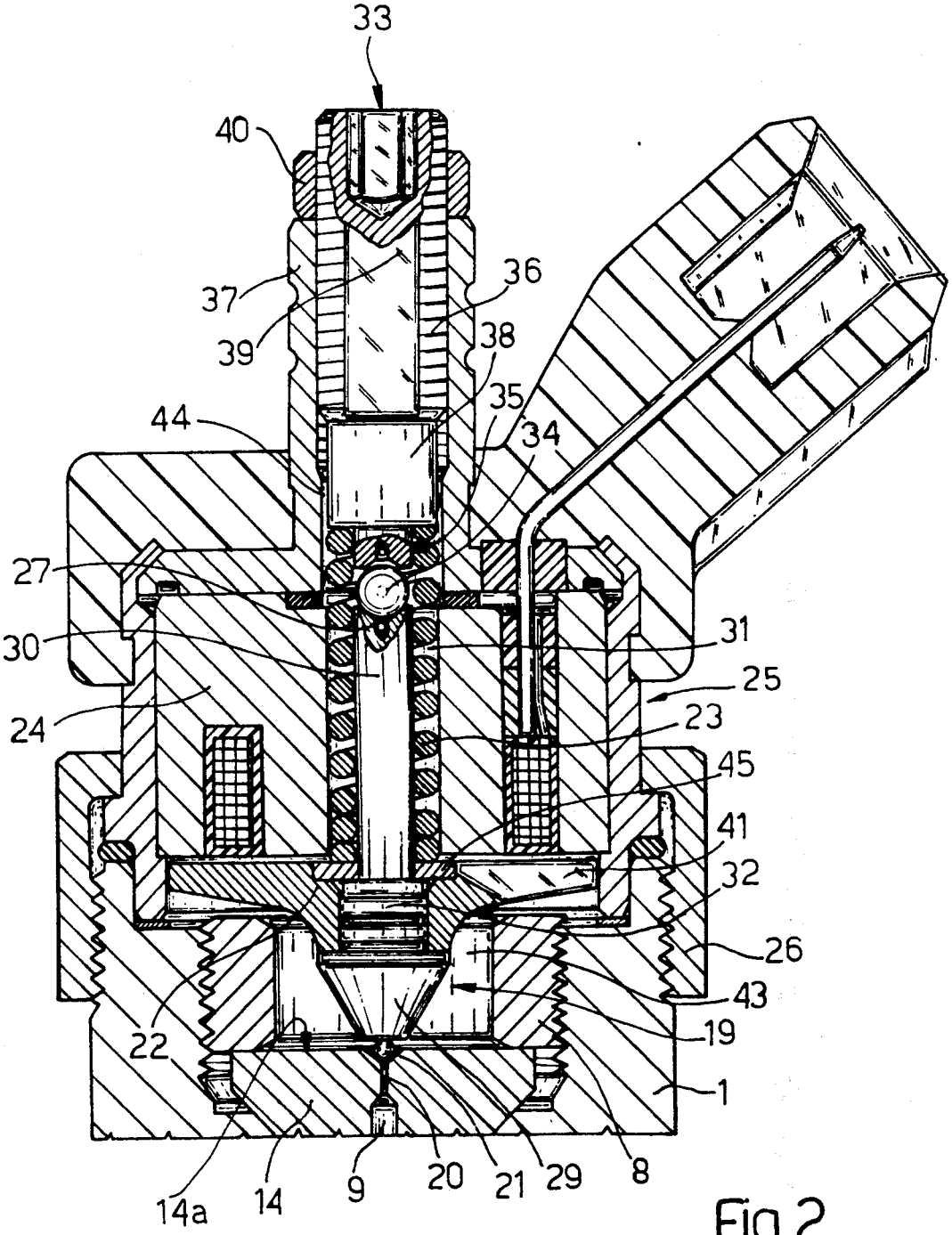
FIG. 2 is a detail of the device of FIG. 1 to illustrate the improvement introduced to the pilot valve with which the device is provided.

The device of the invention further includes a pilot valve, generally indicated 19 and shown in more detail in FIG. 2. This valve is adapted to control the passage of fuel through an outlet aperture 20 formed in the valve body 14, which puts the control chamber 9 into communication with the fuel discharge duct of the device, which is formed within the members of the pilot valve 19 which will be described hereinbelow.

The top of the valve body 14 is delimited by a flat surface **14*a* into which a discharge aperture 20 opens. A threaded ring nut 8 screwed in an axial threaded hole in the body 1 of elongate form presses on this surface in such a way as to fix the valve body 14 onto the body 1. The threaded coupling thus formed resists the axial force which is exerted on the valve body 14 by the fuel under high pressure which fills the chambers 9 and 13** and which acts on the lower surface of the body itself.

The valve further includes a shutter member 29 operable to close the discharge aperture 20, fixed to a disc-shape armature 22 which is urged towards the discharge aperture by the action of at least one coil spring 23. This armature is adapted to be attracted by a core 24 of an electromagnet generally indicated 25, which is fixed to the body 1, being secured to this by means of a ring nut 26. Conveniently, between the shutter member 29 and the discharge aperture 20 there is interposed a ball 21.

According to the improvement of the invention, the armature 22 comprises a rod 30 which is fixed to the shutter member 29, which projects axially upwardly from the member itself and which traverses an axial hole 31 of the core 24; a stop member 33, the axial position of which is adjustable with respect to the body 1, is adapted to constitute a stop for the upper end 27 of the rod 30; between this end and the stop member there is interposed a ball 34. As is clearly seen from FIG. 2 the rod 30 and the shutter member 29 are formed integrally in one piece which includes a central section 32 on which the armature 22 is fitted.

Conveniently, the axial length of the rod 30 is at least equal to the radius of the armature 22 for a purpose which will be indicated hereinbelow. The spring 23 is housed in the axial hole 31 of the core 24 and the rod, in turn is housed within the spring; the ends of this engage, one on a surface of a washer 45 interposed between the spring and the armature 22 and the other on an annular end surface 35 of the stop member 33.

On the ends of the rod 30 and the stop member 33 between which the ball 34 is interposed there are formed conical seats for this ball, clearly visible in FIG. 2.

The stop member conveniently includes a threaded section 36 adapted to be screwed into a corresponding threaded hole of a sleeve 37 fixed to the body 1, and at least one cylindrical section 38 the diameter of which is less than that of the threaded section 36 on the lower end of which the annular surface 35 is formed. The threaded section 36 of the stop member 33 has at least one flat 39 adapted to define, with the threaded hole, a section of the fuel discharge duct.

Further, a clamp nut 40 is screwed onto the threaded section 36 in such a way as to securely fix the stop member in a desired axial position.

On the armature 22 there is formed at least one slot 41 adapted to define a section of the fuel discharge duct.

The operation of the injection device described is as follows.

Fuel under pressure is supplied to the interior of the device through the inlet aperture 11: this passes, through the annular chamber 12 and a radial hole 13, to the interior of the control chamber 9; another stream of fuel originates from the inlet aperture 11 and flows towards the injection orifice 4 through an axial groove 42 formed in the sleeve 16 and through the cavity 5.

The pilot valve 19 is normally in the closure position shown in FIG. 2, under the action of the spring 23 which presses the armature 22 downwardly in such a way as to hold the ball 21 against the corresponding seat formed in the end of the discharge aperture 20.

When the electromagnet 25 is activated the armature 22, attracted b the core 24, is displaced towards it overcoming the force exerted by the spring 23: in this way the ball 21 can become separated from the associated seat allowing the discharge of a certain quantity of fuel from the control chamber. In this way, by reducing the pressure on the active surface 10 of the shutter needle 6, the force applied to it by the pressure of the fuel acting on the surfaces of the needle itself, and against the force exerted by the spring 15, tend to displace the needle upwardly in such a way as to separate the end 7 of it from the injection orifice 4. In this way a suitable quantity of fuel is injected. When the excitation of the electromagnet 25 ceases the pilot valve returns to the closure position.

The fuel, which is discharged from the discharge aperture 20, traverses an annular cavity 43 defined around the cap 29, the slot 41 in the armature, the hole 31 of the core 24, the annular space 44 which is defined between the cylindrical section 38 of the stop member and the sleeve 37, and, finally, the flat 39 of the section 36 of the member itself, in such a way as to flow out towards a fuel discharge tube (not shown).

It is evident that with the improvement of the invention the end of stroke position of the armature 22 can be adjusted in a desired way by suitably positioning the stop member 33 within the sleeve 37; to obtain this the clamp nut 40 is unscrewed and the stop member turned. In this way it is positioned so as to prevent the armature 22 coming into contact with the core 24 in the completely open position of the valve 19, leaving a residual space of desired value between the facing surfaces of these two members. Since, in the open position of the valve, the armature does not come into contact with the core it can be returned immediately to the closure position by the action of the spring 23 as soon as the excitation of the electromagnet 25 ceases: it will be evident that in this way unwanted sticking of the armature on the core which used to give rise to the delay in closure of the valve and therefore detrimentally affect the injection cycle of the device is avoided; moreover, by preventing contact between the armature and the core wear of the facing surfaces of these members will be eliminated.

The presence of the ball 34 interposed between the stop member 33 and the rod 30 substantially forms a spherical hinge the centre of which is located at a rather great distance from the armature itself; in this way oscillations of the armature about the centre of the ball 34 are permitted, with the advantage of improving the closure action of the valve and allowing a more regular movement of the armature 22. It has been found that, when the distance from the centre of the ball 34 from the surface which delimits the upper part of the armature is at least equal to the radius of the armature itself, the small rotations which the armature makes about the centre of the spherical hinge due to the ball 34 are entirely negligible and therefore it can be considered that the movement of the armature itself takes place substantially in the direction of the axis of the device. Since this advantage increases with an increase of the first defined distance it will be appropriate to choose this distance appropriately.

During the operation of the valve the force which is applied to the valve body 14 by the action of the fuel under high pressure which is located within the chambers 10 and 12 and which presses on the lower surface of the body itself is supported by the ring nut 8; this constructionally simple member, and the threaded coupling with the body 1 are able to support very high forces without giving rise to any disadvantages.

The valve body 14 has a very simple form and can be made easily with considerable precision; in particular the surface 14*a* into which the discharge aperture 20 opens, being flat, can be worked with a high surface precision and close tolerances.

It is apparent that the device which has been described can have modifications and variations introduced thereto both to the form and arrangement of the various parts, without departing from the ambit of the invention itself.

We claim:

1. An electromagnetically actuated fuel injection device for an internal combustion engine comprising:

a body of elongate form;

an injection nozzle fixed to the body of provided with at least one fuel injection orifice;

a shutter needle movable axially within the body and the nozzle from a closure position in which it closes the said at least one injection orifice to an open position in which it leaves a passage through the at least one injection orifice open;

a valve body housed within the said body of elongate form and in which is formed a control chamber into which fuel under high pressure is supplied through a fuel inlet aperture and from which this fuel is discharged through a fuel discharge aperture, the said valve body being disposed above the said shutter needle which delimits the lower part of the said control chamber;

an electromagnetically actuated pilot valve adapted to control the passage of fuel through the said discharge aperture, the said valve comprising a shutter member adapted to close the said discharge aperture and fixed to a substantially disc-shaped armature urged toward the said discharge aperture by the action of at least one spring and adapted to be attracted by a core of an electromagnet fixed to the said body of elongate form to separate the said shutter member from the said discharge aperture;

characterized by the fact that the top of the said valve body is delimited by a flat surface into which the said discharge aperture opens, a threaded ring nut screwed into an axial threaded hole in the said body of elongate form pressing onto the said surface in such a way as to fix the said valve body to the said body of elongate form and to resist the force exerted on the said valve body by the said fuel under high pressure.

2. A device according to claim 1, characterised by the fact that it includes;

a rod which is fixed to the said shutter member, which projects from the member itself in the direction of its longitudinal axis and which traverses an axial hole in the said core;

a stop member the position of which is adjustable with respect to the said body of elongate form and which is adapted to constitute a stop for the upper end of the said rod and a ball interposed between the said upper end and the said stop member.

3. A device according to claim 2, characterised by the fact that the axial length of the said rod is at least equal to the radius of the said armature.

4. A device according to claim 2, characterised by the fact that the said at least one spring is a coil spring which is housed in the said axial hole of the said core, the said rod being housed within the interior of the said coil spring and one of the ends of the said coil spring resting on a surface of a washer interposed between the spring itself and the said armature and the other end of the spring on an abutment surface of the said stop member.

5. A device according to claim 2, characterised by the fact that on the said upper end of the said rod and on the end of the said stop member which faces towards the rod there are formed conical seats for the said ball.

6. A device according to claim 5, characterised by the fact that the said stop member includes a first threaded section adapted to be screwed into a corresponding threaded hole of the said body of elongate form, and at least one second cylindrical section of smaller diameter than that of the said first section and in which there is formed the said conical seat, the said first threaded section having at least one flat adapted to define with the said threaded hole of the said body of elongate form a discharge duct for the said fuel.

7. A device according to claim 1, characterised by the fact that between the said shutter member operable to close the said discharge aperture and the aperture itself there is interposed a ball.

* * * * *